United States Patent [19]

Ohuchi et al.

[11] Patent Number: 5,033,432

[45] Date of Patent: Jul. 23, 1991

[54] IDLE SPEED CONTROL APPARATUS AND METHOD FOR AN INTERNAL COMBUSTION ENGINE

[75] Inventors: Hirofumi Ohuchi; Tadahiro Azuma, both of Himeji, Japan

[73] Assignee: Mitsubishi Denki Kabushiki Kaisha, Tokyo, Japan

[21] Appl. No.: 588,225

[22] Filed: Sep. 26, 1990

[30] Foreign Application Priority Data

Oct. 12, 1989 [JP] Japan ..... 1-267026

[51] Int. Cl.[5] ..... F02M 3/00

[52] U.S. Cl. ..... 123/339

[58] Field of Search ..... 123/339, 478, 480; 364/431.07; 62/115

[56] References Cited

U.S. PATENT DOCUMENTS

| | | | |
|---|---|---|---|
| 4,838,223 | 6/1989 | Tanabe et al. | 123/339 |
| 4,841,447 | 6/1989 | Hayashi et al. | 364/431.07 |
| 4,862,851 | 9/1989 | Washino et al. | 123/339 |
| 4,877,003 | 10/1989 | Shimomura et al. | 123/339 |
| 4,883,034 | 11/1989 | Yashiki et al. | 123/339 |
| 4,884,540 | 12/1989 | Kishomoto et al. | 123/339 |
| 4,898,005 | 2/1990 | Sakurai | 62/115 |

FOREIGN PATENT DOCUMENTS

| | | | |
|---|---|---|---|
| 156230 | 12/1980 | Japan | 123/339 |

*Primary Examiner*—Raymond A. Neill

[57] ABSTRACT

An improved idle speed control apparatus for an internal combustion engine capable of effectively preventing instantaneous fluctuations in the number of revolutions per minute of the engine when the engine load is instantaneously changed during engine idling, thereby improving the driver's driving sensation. A bypass passage is connected with an intake manifold of the engine for supplying intake air to the engine while bypassing a throttle valve in the intake manifold. A bypass air controller is disposed on the bypass passage for controlling the amount of bypass air flowing therethrough. In one embodiment, the bypass air controller operates such that when the engine load is altered instantaneously during the engine idling, the amount of intake air is gradually changed from a first level suited to a first operating condition of the engine load to a second level suited to a second opeating condition of the engine load. In another embodiment, the amount of intake air is first changed swiftly from the first level to a third level, and then gradually from the third level to the second level.

10 Claims, 4 Drawing Sheets

$$\text{DUTY CYCLE} = \frac{T_{ON}}{T} \times 100\ [\%]$$

IDLE SPEED CONTROL APPARATUS AND METHOD FOR AN INTERNAL COMBUSTION ENGINE

BACKGROUND OF THE INVENTION

The present invention relates to an idle speed control apparatus and method for an internal combustion engine which controls the rotational speed or the number of revolutions per minute of the engine during idling.

There have been known many internal combustion engines for a vehicle equipped with an idle speed control apparatus which senses the engine load and controls, under the action of an actuator having a relatively high response characteristic, the amount of intake air sucked into the engine at an appropriate level in accordance with the engine load as sensed so as to prevent a sudden change in the rotational speed or the number of revolutions per minute of the engine and stabilize the engine rotation. A typical example of such a high-response actuator is a linear solenoid which is able to control the amount of intake air in accordance with the magnitude of current supplied thereto. Another example is a duty solenoid in which a solenoid is periodically turned on and off with a prescribed cycle so as to regulate the duty ratio thereof whereby the amount of intake air sucked into the engine is properly controlled.

In operation of the above-described idle speed control apparatuses, during stable operations of the engine in which the engine load is substantially constant or gradually changing as when the engine is idling or operating under a constant load such as when an air conditioner is on, when a shift lever for an automatic transmission (hereinafter simply referred to as A/T) for the engine is in a drive range (hereinafter simply referred to as a D range) and the like, the amount of intake air sucked into the engine is calculated uniquely depending on the load conditions of the engine. On the other hand, during transient or rapidly changing conditions of the engine in which the engine load is rapidly changing as when an air conditioner is being turned on or off, the amount of intake air is controlled such that the target level for air intake is changed from a first value for the off-condition of the air conditioner into a second value for the on-condition thereof.

With the above-described known idle speed control apparatuses, however, at the time when the engine load is changing as when the air conditioner is being turned on or off, when an automatic transmission is being changed from the neutral range into the drive range, or the like, sometimes there arises a situation in which the load condition of the engine as sensed by a load sensor does not match the actual load on the engine due, for example, to a mechanical delay in the transmission of the operation from the air conditioner to the engine, due to a hydraulic delay in the transmission of the oil pressure in the automatic transmission.

Accordingly, in this state of mismatching between the actual and the sensed engine load, when the amount of intake air is changed from a first value suited to the inoperative condition of the air conditioner into a second value suited to the operative condition thereof or vice versa, the response of the actuator for controlling the amount of intake air is relatively quick so that the amount of intake air to be sucked into the engine instantaneously becomes too great or too small, resulting in an instantaneous increase or decrease in the idle number of revolutions per minute of the engine. This sometimes leads to an impairment in the driving sensation of the driver.

SUMMARY OF THE INVENTION

The present invention is intended to obviate the above-described problems of the known idle speed control apparatuses.

It is an object of the present invention to provide an improved idle speed control apparatus and method for controlling the idle speed of an internal combustion engine which is able to effectively prevent instantaneous fluctuations in the number of revolutions per minute of the engine when the engine load is instantaneously changed during engine idling, thereby improving the driver's driving sensation.

In order to achieve the above object, according to one aspect of the present invention, there is provided an idle speed control apparatus for an internal combustion engine which includes an intake manifold for supplying intake air to the engine and a throttle valve disposed in the intake manifold for adjusting the amount of intake air sucked into the engine, the idle speed control apparatus comprising:

a bypass passage connected with the intake manifold for supplying intake air to the engine while bypassing the throttle valve;

a bypass air controller disposed on the bypass passage for controlling the amount of bypass air flowing therethrough;

sensing means for sensing the operating condition of an engine load during the idling operation of the engine;

control means for calculating a first and a second control quantity for the bypass air controller, the first and the second control quantity respectively corresponding to a first and a second operating condition of the engine load as sensed by the sensing means, the control means controlling the control quantity for the bypass air controller in such a manner that the control quantity is gradually changed from the first control quantity to the second control quantity at the time when the engine load is instantaneously altered from the first operating condition to the second operating condition or vice versa.

According to another aspect of the present invention, there is provided an idle speed control apparatus for an internal combustion engine which includes an intake manifold for supplying intake air to the engine and a throttle valve disposed in the intake manifold for adjusting the amount of intake air sucked into the engine, the idle speed control apparatus comprising:

a bypass passage connected with the intake manifold for supplying intake air to the engine while bypassing the throttle valve;

a bypass air controller disposed on the bypass passage for controlling the amount of bypass air flowing therethrough;

sensing means for sensing the operating condition of an engine load during the idling operation of the engine;

control means for calculating a first, a second and a third control quantity for the bypass air controller, the first and the second control quantity respectively corresponding to a first and a second operating condition of the engine load as sensed by the sensing means, the control means controlling the control quantity for the bypass air controller in such a manner that the control quantity is first changed swiftly from the first control quantity to the third control quantity and then gradually from the third control quantity to the second control quantity at the time when the engine load is instantaneously altered from the first operating condition to the second operating condition or vice versa.

In an embodiment, the first operating condition of the engine is an off-condition of the engine load, and the second operating condition of the engine is an on-condition of the engine load.

Preferably, the control means controls the duty cycle of the bypass air controller in accordance with the control quantity.

According to a further aspect of the present invention, there is provided a method for controlling the idle speed of an internal combustion engine by controlling the amount of intake air sucked into the engine, the method comprising: determining whether the engine is idling;

detecting whether an engine load is altered rapidly during the idling operation of the engine; and changing the amount of intake air in a gradual manner from a first level suited to a first operating condition of the engine load to a second level suited to a second operating condition of the engine load when the engine load is instantaneously altered during the idling operation of the engine.

According to a yet further aspect of the present invention, there is provided a method for controlling the idle speed of an internal combustion engine by controlling the amount of intake air sucked into the engine, the method comprising:

determining whether the engine is idling;

detecting whether an engine load is altered rapidly during the idling operation of the engine; and changing the amount of intake air from a first level suited to a first operating condition of the engine load to a second level suited to a second operating condition of the engine load, when the engine load is instantaneously altered during the idling operation of the engine, in such a manner that the amount of intake air is first changed swiftly from the first level to a third level, and then gradually from the third level to the second level.

The above and other objects, features and advantages of the present invention will become more readily apparent from the following detailed description of a preferred embodiment of the invention taken in conjunction with the accompanying drawings.

DESCRIPTION OF THE PREFERRED EMBODIMENT

The present invention will now be described in detail with reference to a preferred embodiment thereof as illustrated in the accompanying drawings.

Figure 1:
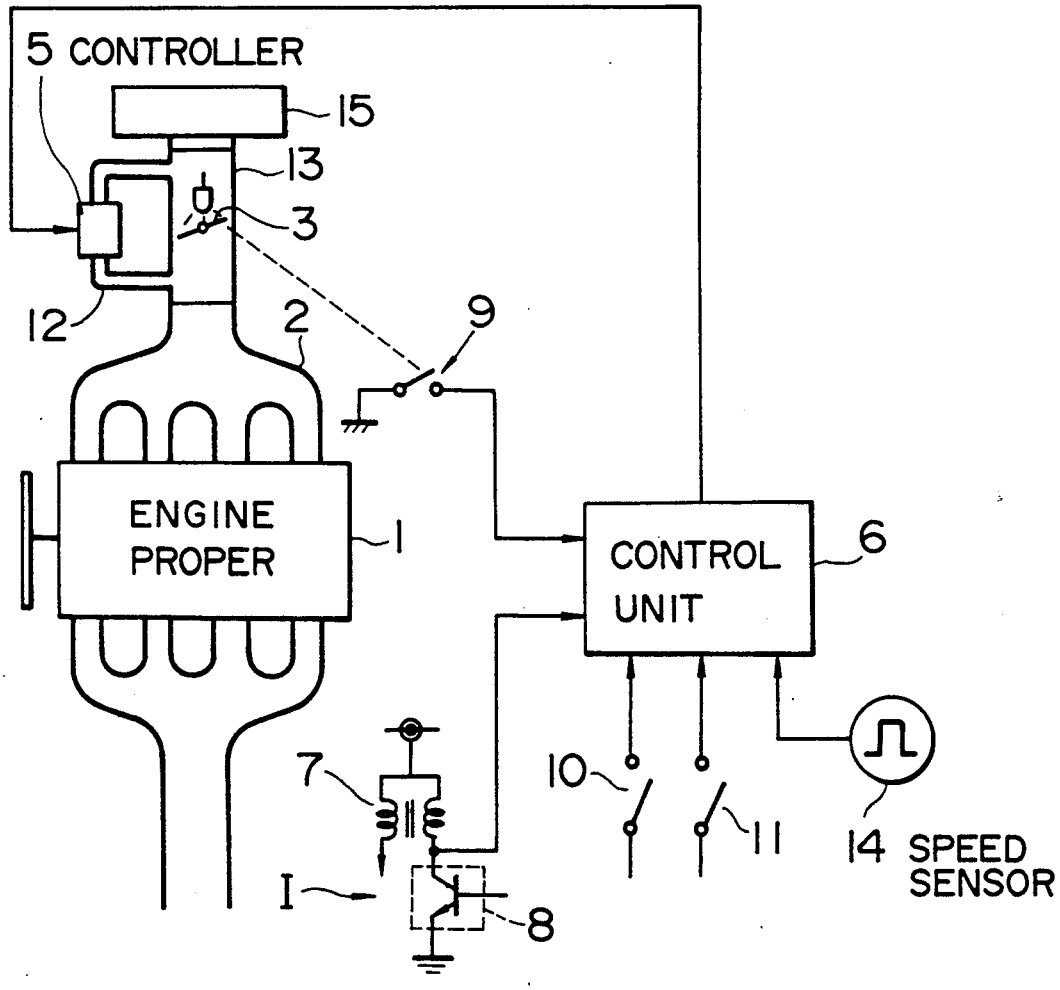
FIG. 1 is a block diagram showing the general construction of an idle speed control apparatus for an internal combustion engine in accordance with the present invention.

Referring to the drawings and first to FIG. 1, there is diagrammatically shown the general arrangement of a idle speed control apparatus for an internal combustion engine constructed in accordance with the principles of the present invention. In FIG. 1, an engine proper 1 for a multi-cylinder (four-cylinder) engine of a vehicle has an intake manifold 2 which is connected to one end of a tubular throttle body 13 the other end of which is connected to an air cleaner 15. In the present invention, the throttle body 13 is construed as part of the intake manifold 2. The throttle body 13 defines therein an intake air passage in which a throttle valve 3 is rotatably disposed for controlling the flow of intake air sucked into the engine proper 1. A bypass air passage 12 is connected at its opposite ends to the throttle body 13 for supplying intake air to the engine proper 1 while bypassing the throttle valve 3. Disposed on the bypass air passage 12 is a bypass air controller 5 for controlling the amount of bypass air flowing therethrough so as to change the number of revolutions per minute of the engine. The bypass air controller 5 is controlled by a control unit 6 which will be described in detail later. The respective cylinders of the engine proper 1 are ignited by an ignition device I which includes an ignition coil 7 and an igniter 8 in the form of a transistor for controlling the power supply to the ignition coil 7. An ignition signal is inputted from the ignition device I to the control unit 6 which calculate the number of revolutions per minute of the engine. Sensor means is provided for sensing the load and operating conditions of the engine. The sensor means includes an idle sensor 9 in the form of an idle switch which is turned on during idling for sensing the idle operation of the engine, a load sensor 10 in the form of a switch which is closed and opened for turning an air conditioner on and off, a drive sensor 11 for sensing the drive condition of an automatic transmission for the vehicle, i.e., sensing whether a shift lever for the automatic transmission is in the drive range (D range), and a speed sensor 14 for sensing the speed of the vehicle. The output signals of these sensors are inputted to the control unit 6.

Figure 2:
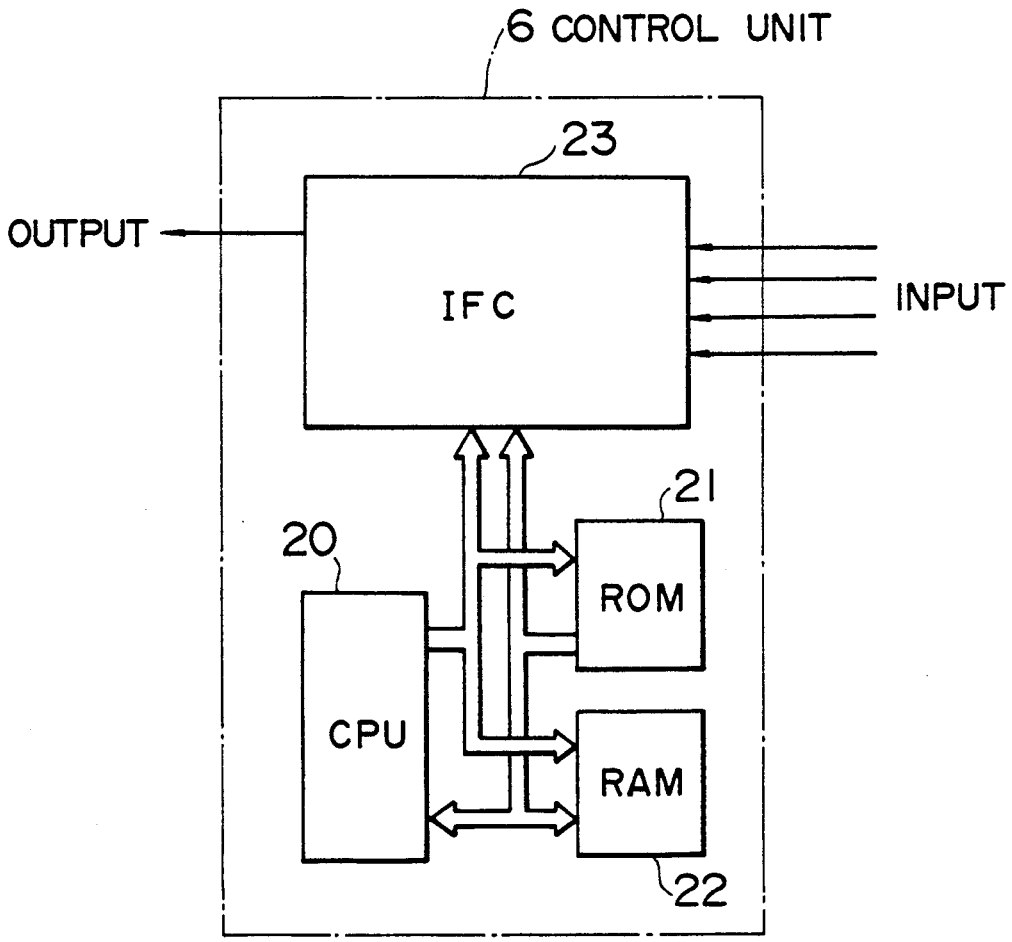
FIG. 2 is a block diagram showing a more concrete structure of the idle speed control apparatus of FIG. 1.

As clearly shown in FIG. 2, the control unit 6 includes a central processing unit (CPU) 20 for executing programs for determining a control quantity for the bypass air controller 5 in accordance with the load condition of the engine proper 1, a read only memory (ROM) 21 in which the programs, various constants and values, etc., necessary for calculations of the control quantity performed by the CPU 20 are stored, a random access memory (RAM) 22 for temporarily storing the results of calculations, and an interface 23 for receiving the ignition signal from the ignition device I and the output signals from the various sensors 9, 10, 11, 14, and outputting a control signal to the bypass air controller 5. In this regard, the ignition signal from the ignition device I is construed as the output signal from a kind of an ignition sensor. Based on the information inputted from the various sensors, the control unit 6 calculates an optimal quantity of bypass air to be supplied to the engine proper 1 via the bypass passage 12 in accordance with the engine load as sensed, and controls the duty cycle of the bypass air controller 5 in such a manner that the actual quantity of bypass air flowing through the bypass passage 12 becomes equal to the optimal quantity thus calculated.

The operation of the above-described embodiment will now be described with particular reference to FIG. 3.

Figure 3:
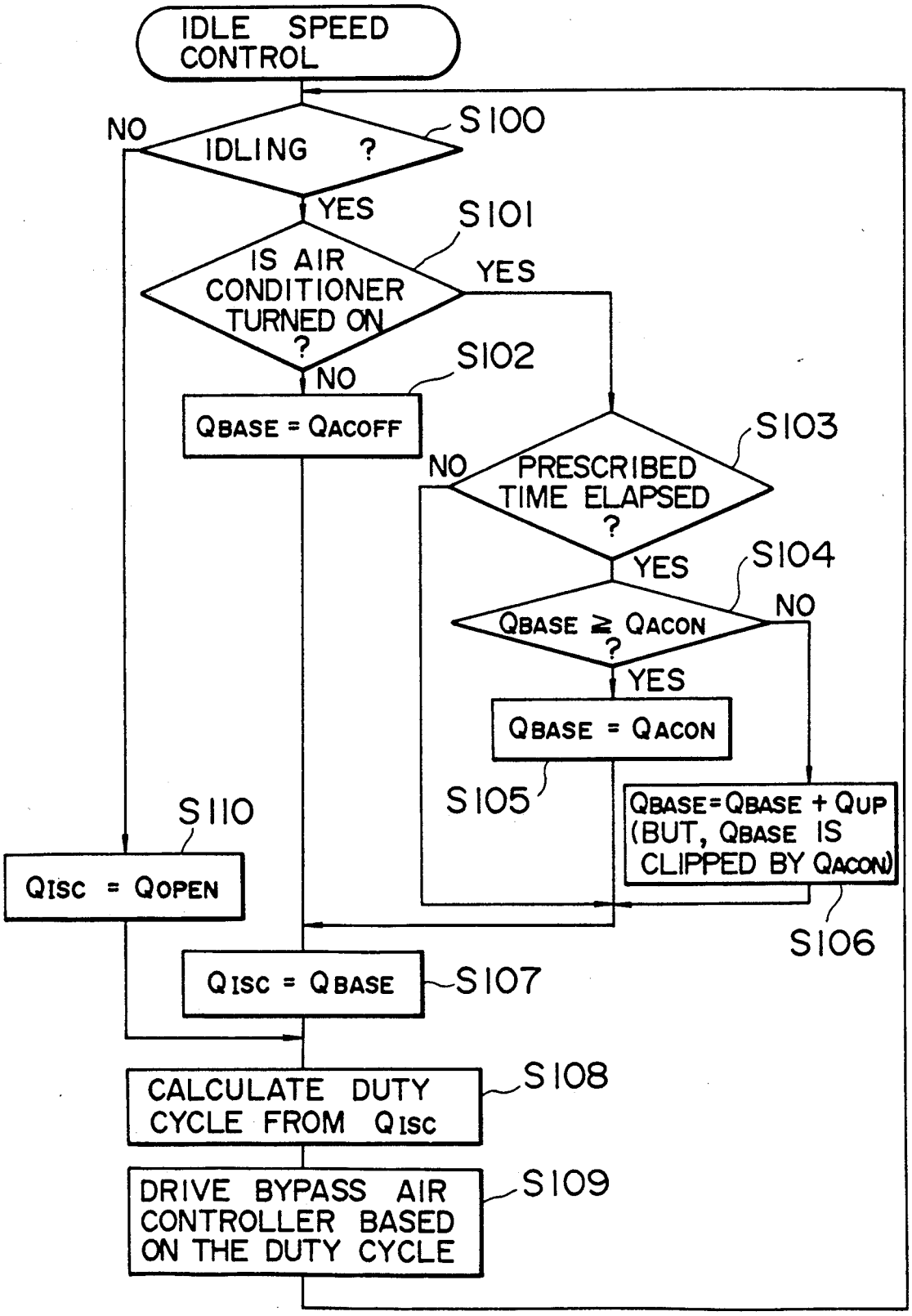
FIG. 3 is a flow chart showing the operation of the embodiment of FIGS. 1 and 2.

When the engine is first started to run, the CPU 20 performs the processing of a routine as illustrated in FIG. 3 in accordance with a program stored in the ROM 21. Specifically, in Step S100, the CPU 20 reads in the output signal of the idle switch 9 which is inputted to the interface 23, and it determines, based on this signal, whether or not the engine is idling, depending upon the on- or off-condition of the idle switch 9, or the presence or absence of the output signal from the speed sensor 14 (which exists when the vehicle is travelling), or the like.

As a result, if it is determined that the engine is not idling, the program goes to Step S110 where a control quantity $Q_{ISC}$ for controlling the bypass air controller 5 is substituted by an open control value $Q_{OPEN}$ which is preset for non-idling operations of the engine.

On the other hand, if it is determined that the engine is idling, the program goes to Step S101 where the CPU 20 reads in the output signal of the load sensor 10 through the interface 23, and determines whether the air conditioner is in or out of operation. If the air conditioner is determined to be out of operation, the program goes to Step S102 where an idle control quantity $Q_{BASE}$ for the idling operation of the engine is substituted by a load-off control value $Q_{ACOFF}$ which is suitable for idling without the operation of the air conditioner.

Figure 4:
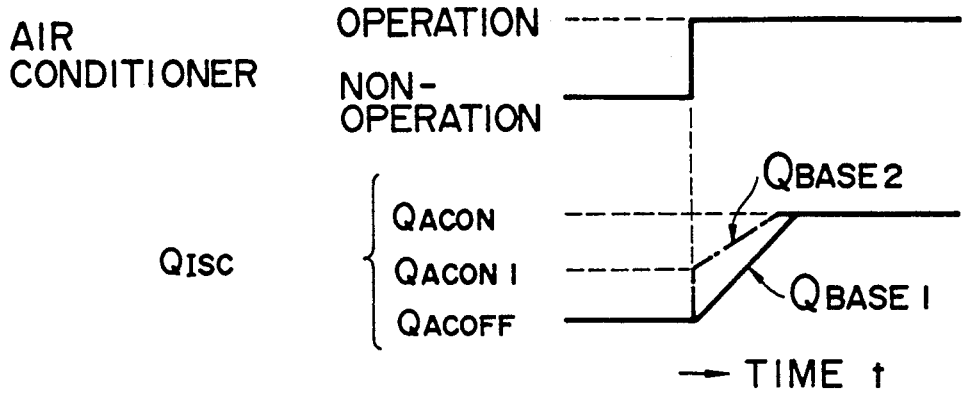
FIG. 4 is a diagrammatic view showing a time-related change in the control quantity ($Q_{ISC}$) for a bypass air controller of the above embodiment.

On the other hand, if the air conditioner is determined to be in operation, the program goes from Step S101 to Step S103 where the CPU 20 determines whether a predetermined time has elapsed from the start-up of the air conditioner, by using a timer (not shown) incorporated therein. If the answer is NO, then the program goes to Step S107. On the other hand, if the answer is YES in Step 103, then in Step S104, comparison is made between the idle control quantity $Q_{BASE}$ and a load-dependent or load-off control quantity $Q_{ACON}$ for the steady operating state of the air conditioner. If the idle control quantity $Q_{BASE}$ is greater than or equal to the load-dependent control quantity $Q_{ACON}$, then in Step S105, the $Q_{BASE}$ is made equal to or replaced by the $Q_{ACON}$. If the $Q_{BASE}$ is less than the $Q_{ACON}$, then in Step S106, a prescribed increment $Q_{UP}$, which defines the gradient (i.e., the rate of change) of the $Q_{BASE}$ as shown in FIG. 4, is added to the idle control quantity $Q_{BASE}$ to provide a new $Q_{BASE}$. In this connection, the new $Q_{BASE}$ thus calculated is clipped by the $Q_{ACON}$ so as not to exceed the $Q_{ACON}$.

Subsequently, the program goes from Step S105 or S106 to Step S107 where the control quantity $Q_{ISC}$ is substituted by the idle control quantity $Q_{BASE}$ which was previously calculated in Step S102, S105 or S106.

Figure 5:
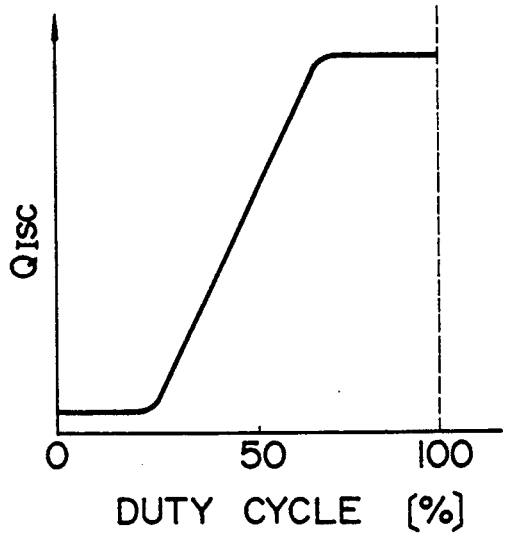
FIG. 5 is a characteristic view showing the relation between the control quantity ($Q_{ISC}$) and the control signal (duty cycle) for the bypass air controller of the above embodiment.

In Step S108, a duty cycle $T_{ON}/T$ for driving the bypass air controller 5 is calculated based on the control quantity $Q_{ISC}$, which is substituted by the idle control quantity $Q_{BASE}$ in Step S107, using a certain relation between the control quantity $Q_{ISC}$ and the duty cycle of the bypass air controller 5, which is stored in ROM 21 and illustrated in FIG. 5.

Figure 6:
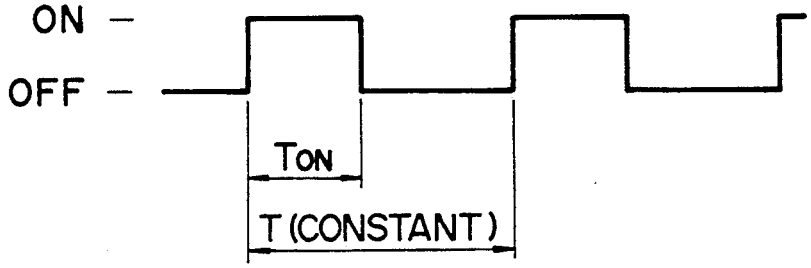
FIG. 6 is a waveform diagram of a control signal for a bypass air controller of the above embodiment.

In Step S109, based on the duty cycle in percentage $T_{ON}/T \times 100\%$ thus calculated, the CPU 20 generates a control signal, as shown in FIG. 6, which is sent through the interface 23 to the bypass air controller 5 for controlling the amount of bypass air supplied to the engine proper 1 through the bypass passage 12 in accordance with the duty cycle. Thereafter, the program returns to the first Step S100, and the same process steps are repeated. Thus, according to the calculations as repeatedly performed in Steps S101 through S107, the control quantity $Q_{ISC}$ gradually increases with the gradient $Q_{UP}$ from the load-off control quantity $Q_{ACOFF}$ (a first control quantity) to the load-dependent control quantity $Q_{ACON}$ (a second control quantity) when the air conditioner is turned on, as clearly shown by the solid line $Q_{BASE1}$ in FIG. 4.

In the above-described manner, the control unit 6 is able to gradually change the control quantity for the bypass air controller 5 even during a rapidly changing state of the engine load, thereby preventing instantaneous fluctuations in the number of revolutions per minute of the engine.

Although in the above description, the engine load is suddenly increased from a low load to a high load, the same result is attained similarly when the engine load suddenly decreases. Also, the engine load is in the form of an air conditioner, but the same result will be obtained with any other type of engine load such as an automatic transmission in which the engine load is suddenly changed when the transmission is shifted from the neutral range into the drive range or vice versa.

Further, although the load-off control quantity $Q_{ACOFF}$ for idling without the operation of the air conditioner is used for controlling the duty cycle of the bypass air controller 5, other kind of control quantity $Q_{ACON1}$, as shown in FIG. 4, can likewise be employed with substantially the same result. Specifically, if the control quantity $Q_{ISC}$ is gradually changed from the $Q_{ACOFF}$ to the $Q_{ACON}$ or vise versa upon a sudden change in the engine load, as shown by the solid line $Q_{BASE1}$ in FIG. 4, there would sometimes be a case in which the amount of intake air momentarily become inadequate or excessive for proper idling operation, resulting in instantaneous variations in the idle speed of the engine. To prevent such a situation, the control quantity $Q_{ISC}$ can first be changed swiftly from the $Q_{ACOFF}$ (a first control quantity) to an appropriate level $Q_{ACON1}$ (a third control quantity) suitable for preventing instantaneous variations in the idle speed, and then gradually therefrom to the load-dependent control quantity $Q_{ACON}$ (a second control quantity), as shown by the chain-dotted line $Q_{BASE2}$ in FIG. 4. Though in this case, the third control quantity $Q_{ACON1}$ is illustrated to be between the first control quantity $Q_{ACOFF}$ and the second control quantity $Q_{ACON}$ in FIG. 4, it may be a value greater than the second control quantity $Q_{ACON}$.

As apparent from the foregoing, according to the present invention, the operating condition of the engine load such as, for example, a vehicular air conditioner, which can be operated during idling, is detected so that a control quantity for controlling the amount of intake air sucked into the engine is made to gradually change into an optimal quantity matching the changed engine load. Accordingly, it is possible to effectively prevent instantaneous variations or fluctuations in the number of revolutions per minute of the engine upon a rapid change in the engine load, thus improving the driver's driving sensation.

What is claimed is:

1. An idle speed control apparatus for an internal combustion engine which includes an intake manifold for supplying intake air to the engine and a throttle valve disposed in the intake manifold for adjusting the amount of intake air sucked into the engine, said idle speed control apparatus comprising:

a bypass passage connected with the intake manifold for supplying intake air to the engine while bypassing the throttle valve;

a bypass air controller disposed on said bypass passage for controlling the amount of bypass air flowing therethrough;

sensing means for sensing the operating condition of an engine load during the idling operation of the engine;

control means for calculating a first and a second control quantity for said bypass air controller, the first and the second control quantity respectively corresponding to a first and a second operating condition of the engine load as sensed by said sensing means, said control means controlling the control quantity for said bypass air controller in such a manner that the control quantity is gradually changed from the first control quantity to the second control quantity at the time when the engine load is instantaneously altered from the first operating condition to the second operating condition or vice versa.

2. An idle speed control apparatus according to claim 1, wherein the first operating condition of the engine is an off-condition of the engine load.

3. An idle speed control apparatus according to claim 1, wherein the second operating condition of the engine is an on-condition of the engine load.

4. An idle speed control apparatus according to claim 1, wherein said control means controls the duty cycle of said bypass air controller in accordance with the control quantity.

5. An idle speed control apparatus for an internal combustion engine which includes an intake manifold for supplying intake air to the engine and a throttle valve disposed in the intake manifold for adjusting the amount of intake air sucked into the engine, said idle speed control apparatus comprising:

a bypass passage connected with the intake manifold for supplying intake air to the engine while bypassing the throttle valve;

a bypass air controller disposed on said bypass passage for controlling the amount of bypass air flowing therethrough;

sensing means for sensing the operating condition of an engine load during the idling operation of the engine;

control means for calculating a first, a second and a third control quantity for said bypass air controller, the first and the second control quantity respectively corresponding to a first and a second operating condition of the engine load as sensed by said sensing means, said control means controlling the control quantity for said bypass air controller in such a manner that the control quantity is first changed swiftly from the first control quantity to the third control quantity and then gradually from the third control quantity to the second control quantity at the time when the engine load is instantaneously altered from the first operating condition to the second operating condition or vice versa.

6. An idle speed control apparatus according to claim 5, wherein the first operating condition of the engine is an off-condition of the engine load.

7. An idle speed control apparatus according to claim 5, wherein the second operating condition of the engine is an on-condition of the engine load.

8. An idle speed control apparatus according to claim 5, wherein said control means controls the duty cycle of said bypass air controller in accordance with the control quantity.

9. A method for controlling the idle speed of an internal combustion engine by controlling the amount of intake air sucked into the engine, said method comprising:

determining whether the engine is idling;

detecting whether an engine load is altered rapidly during the idling operation of the engine; and changing the amount of intake air in a gradual manner from a first level suited to a first operating condition of the engine load to a second level suited to a second operating condition of the engine load when the engine load is instantaneously altered during the engine idling.

10. A method for controlling the idle speed of an internal combustion engine by controlling the amount of intake air sucked into the engine, said method comprising:

determining whether the engine is idling;

detecting whether an engine load is altered rapidly during the idling operation of the engine; and changing the amount of intake air from a first level suited to a first operating condition of the engine load to a second level suited to a second operating condition of the engine load, when the engine load is instantaneously altered during the engine idling, in such a manner that the amount of intake air is first changed swiftly from the first level to a third level, and then gradually from the third level to the second level.

* * * * *